US011519676B2

(12) United States Patent
Bae et al.

(10) Patent No.: US 11,519,676 B2
(45) Date of Patent: Dec. 6, 2022

(54) HEAT EXCHANGER AND REFRIGERATOR INCLUDING THE SAME

(71) Applicant: Samsung Electronics Co., Ltd., Suwon-si (KR)

(72) Inventors: Jungwook Bae, Suwon-si (KR); Kookjeong Seo, Suwon-si (KR); Myounghun Kim, Suwon-si (KR); Heeyuel Roh, Suwon-si (KR); Seulki Min, Suwon-si (KR); Dongwoo Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 114 days.

(21) Appl. No.: 16/946,605

(22) Filed: Jun. 29, 2020

(65) Prior Publication Data

US 2020/0408472 A1 Dec. 31, 2020

(30) Foreign Application Priority Data

Jun. 27, 2019 (KR) ..... 10-2019-0076788

(51) Int. Cl.
*F28F 9/013* (2006.01)
*F28F 1/32* (2006.01)

(52) U.S. Cl.
CPC ..... *F28F 1/325* (2013.01); *F28F 9/013* (2013.01); *F28F 2210/10* (2013.01); *F28F 2215/08* (2013.01)

(58) Field of Classification Search
CPC .... F28F 1/12; F28F 1/325; F28F 9/013; F28F 2215/08; F28F 2210/10
See application file for complete search history.

(56) References Cited

U.S. PATENT DOCUMENTS

| | | | | |
|---|---|---|---|---|
| 4,369,350 | A * | 1/1983 | Kobayashi | F25D 21/08 219/201 |
| 9,874,403 | B2 * | 1/2018 | Candeo | B23P 15/26 |
| 10,408,525 | B2 * | 9/2019 | Shin | F28D 1/0477 |
| 10,746,445 | B2 * | 8/2020 | Kim | F25D 11/02 |
| 2002/0023744 | A1 * | 2/2002 | Kim | F28F 1/32 165/177 |

(Continued)

FOREIGN PATENT DOCUMENTS

| | | | |
|---|---|---|---|
| CN | 109737676 | A | 5/2019 |
| JP | 53116546 | A * | 3/1977 |

(Continued)

OTHER PUBLICATIONS

Communication pursuant to Article 94(3) EPC dated Aug. 26, 2021, in connection with European Application No. 20182688.0, 6 pages.

(Continued)

*Primary Examiner* — Devon Russell

(57) ABSTRACT

A refrigerator comprising a storeroom and a cold air supplier configured to supply cold air into the storeroom. Where the cold air supplier comprises a heat exchanger producing cold air, a duct accommodating the heat exchanger and defining a flow path for air to pass through the heat exchanger, and a fan generating an air flow inside the duct. Where the heat exchanger comprises a tube in which a refrigerant flows and a fin coupled to an outer surface of the tube. Where the tube is eccentrically arranged to a side of the duct.

15 Claims, 16 Drawing Sheets

(56) References Cited

U.S. PATENT DOCUMENTS

| | | | | |
|---|---|---|---|---|
| 2013/0284416 | A1* | 10/2013 | Jindou | F28F 1/12 165/181 |
| 2016/0187048 | A1* | 6/2016 | Jeong | F25D 11/006 62/187 |

FOREIGN PATENT DOCUMENTS

| | | | |
|---|---|---|---|
| JP | S53-116546 | A | 10/1978 |
| JP | S55-149153 | U | 10/1980 |
| JP | H11-304335 | A | 11/1999 |
| JP | 6071427 | B2 | 2/2017 |
| KR | 10-1999-0065366 | A | 8/1999 |
| KR | 10-2009-0033743 | A | 4/2009 |
| KR | 10-2018-0038623 | A | 4/2018 |

OTHER PUBLICATIONS

European Search Report dated Oct. 26, 2020 in connection with European Patent Application No. 20 18 2688, 9 pages.

* cited by examiner

HEAT EXCHANGER AND REFRIGERATOR INCLUDING THE SAME

CROSS-REFERENCE TO RELATED APPLICATION

This application is based on and claims priority under 35 U. S. C. § 119 to Korean Patent Application No. 10-2019-0076788 filed on Jun. 27, 2019, the disclosure of which is incorporated herein by reference in its entirety.

BACKGROUND

1. Field

The disclosure relates to a heat exchanger and a refrigerator including the same.

2. Discussion of Related Art

Refrigerators are devices having a storeroom and a cold air supply for supplying cold air into the storeroom to keep groceries fresh. Temperatures in the storeroom remain within a certain range required to keep the groceries fresh. The storeroom has an open front, which is closed by a door at ordinary times to maintain the temperature of the storeroom. The storeroom is partitioned by a wall into a freezer chamber and a fridge chamber, the freezer and fridge chambers being opened or shut by their respective doors.

The storeroom receives cold air from a cold air supplier to maintain its internal temperature within a certain range. The cold air supplier includes a heat exchanger for producing cold air, a duct accommodating the heat exchanger and defining an air flow path, and a fan for generating air flows in the duct and guiding the cold air produced by the heat exchanger to be supplied into the storeroom.

The heat exchanger includes a tube in which a refrigerant flows, and a plurality of fins coupled to the outer surface of the tub. The refrigerant flowing in the tube exchanges heat with the air outside the tube through the plurality of fins bordering the outer surface of the tube. The refrigerant absorbs heat from the air, so the air cools down. Accordingly, the efficiency of the heat exchanger largely depends on efficient heat exchange between the refrigerant and the air.

SUMMARY

The disclosure provides a heat exchanger with enhanced efficiency and a refrigerator including the heat exchanger.

According to an embodiment of the disclosure, a refrigerator includes a storeroom; and a cold air supplier configured to supply cold air into the storeroom, wherein the cold air supplier includes a heat exchanger producing cold air; a duct accommodating the heat exchanger and defining a flow path for air to pass through the heat exchanger; and a fan generating an air flow inside the duct, wherein the heat exchanger includes a tube in which a refrigerant flows; and a fin coupled to the outer surface of the tube, and wherein the tube is arranged to be lopsided to a side of the duct.

The tube may be arranged to be lopsided to a side on which the air flow generated by the fan in the duct is relatively fast.

The duct may include an inlet on one side, through which air of the storeroom flows in, and the tub of the heat exchanger may be arranged to be lopsided to the other side opposite from the side on which the inlet is arranged.

The heat exchanger and the duct may be arranged behind the storeroom, and the tube of the heat exchanger may be arranged to be lopsided to the rear side of the duct.

The fin may include a hole through which the tube passes, and the hole may be arranged to be lopsided from the center of the fin.

The fin may include a cut-out formed on a side opposite to the side on which the hole is arranged.

The fin may be shaped like a plate including a bent portion.

The bent portion may be formed in a portion of the fin in which the hole is not formed.

The bent portion may be arranged to be lopsided to the same side on which the hole is arranged.

The cold air supplier may further include a heater for getting rid of frost formed on the heat exchanger, and the heater may be arranged to pass along the side and bottom of the heat exchanger.

The cold air supplier may include a bracket to support the heat exchanger and the heater, and the bracket may include a recess on a side and bottom of the bracket to support the heater.

The bracket may include a plurality of recesses on a side of the bracket to support the heater.

The cold air supplier may further include a heater for getting rid of frost formed on the heat exchanger, and the heater may be arranged to pass through the cut-out.

The heat exchanger may include a plurality of fins arranged in a direction parallel to a flow direction of the air, each of the plurality of fins may include the cut-out at a corner on one side, and the heater may pass through space formed by two cut-outs of two neighboring fins of the plurality of fins.

The heat exchanger may include a plurality of fins arranged in a direction perpendicular to a flow direction of the air, and each of the plurality of fins may include a plurality of cut-outs on an edge of a side.

According to another aspect of the disclosure, a refrigerator includes a storeroom; and a heat exchanger arranged behind the storeroom, and including a plurality of fins and a tube in which a refrigerant flows, wherein the tube is arranged to be lopsided to a rear side of the plurality of fins.

The refrigerator may further include a heater arranged underneath and in front of the heat exchanger, and each of the plurality of fins may include a cut-out formed on a front side for the heater to pass through.

Each of the plurality of fins may include a bent portion formed in a portion in which the tube does not pass.

According to another aspect of the disclosure, a heat exchanger includes a duct defining a flow path of air; a tube in which a refrigerant flows; and a fin including a hole through which the tube passes, wherein the hole is arranged to be lopsided to a side on which an air flow in the duct is relatively fast.

The fin may include a cut-out formed on a side opposite to the side on which the hole is arranged.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Figure 1:
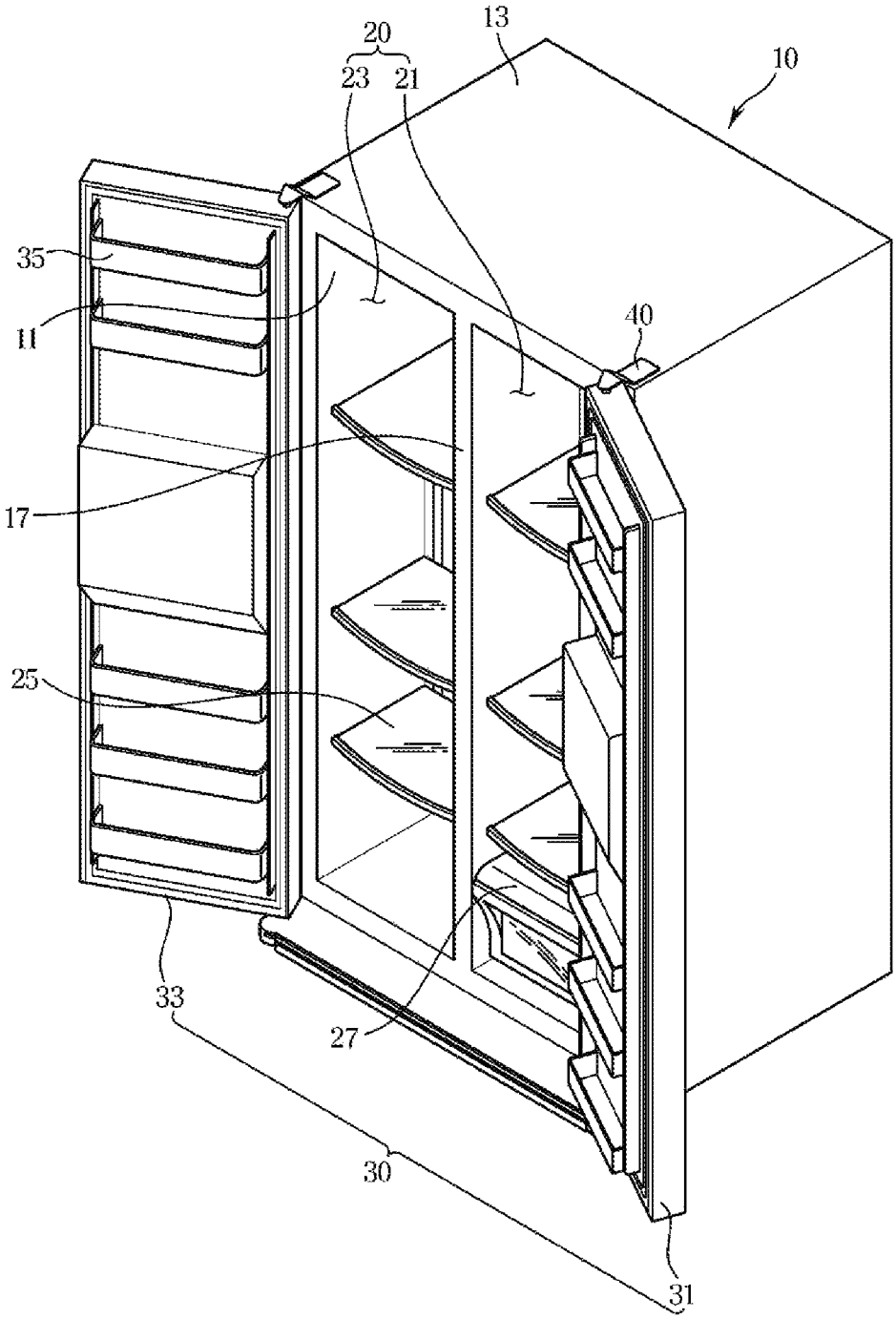
FIG. 1 illustrates a perspective view of a refrigerator, according to an embodiment of the disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments and features as described and illustrated in the disclosure are merely examples, and there may be various modifications replacing the embodiments and drawings at the time of filing this application.

Throughout the drawings, like reference numerals refer to like parts or components. For the sake of clarity, the elements of the drawings are drawn with exaggerated forms and sizes.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the disclosure.

In general, refrigerators may be classified by types based on the form of storerooms and doors. There may be top mounted freezer (TMF) typed refrigerators in which a storeroom is partitioned by a horizontal partition wall into upper and lower chambers with a freezer formed in the upper chamber and a fridge formed in the lower chamber, and bottom mounted freezer (BMF) typed refrigerators in which a fridge is formed in the upper chamber and a freezer is formed in the lower chamber.

Furthermore, there may be side by side (SBS) typed refrigerators in which a storeroom is partitioned by a vertical partition wall into left and right chambers with a freezer formed in one chamber and a fridge formed in the other chamber, and French door refrigerator (FDR) typed refrigerators in which a storeroom is partitioned by a horizontal partition wall into upper and lower chambers with a fridge formed in the upper chamber and a freezer formed in the lower chamber.

In this specification, the SBS typed refrigerator will be described for convenience of explanation, but embodiments of the disclosure are not limited to the SBS typed refrigerators.

Embodiments of the disclosure will now be described in detail with reference to accompanying drawings.

Figure 2:
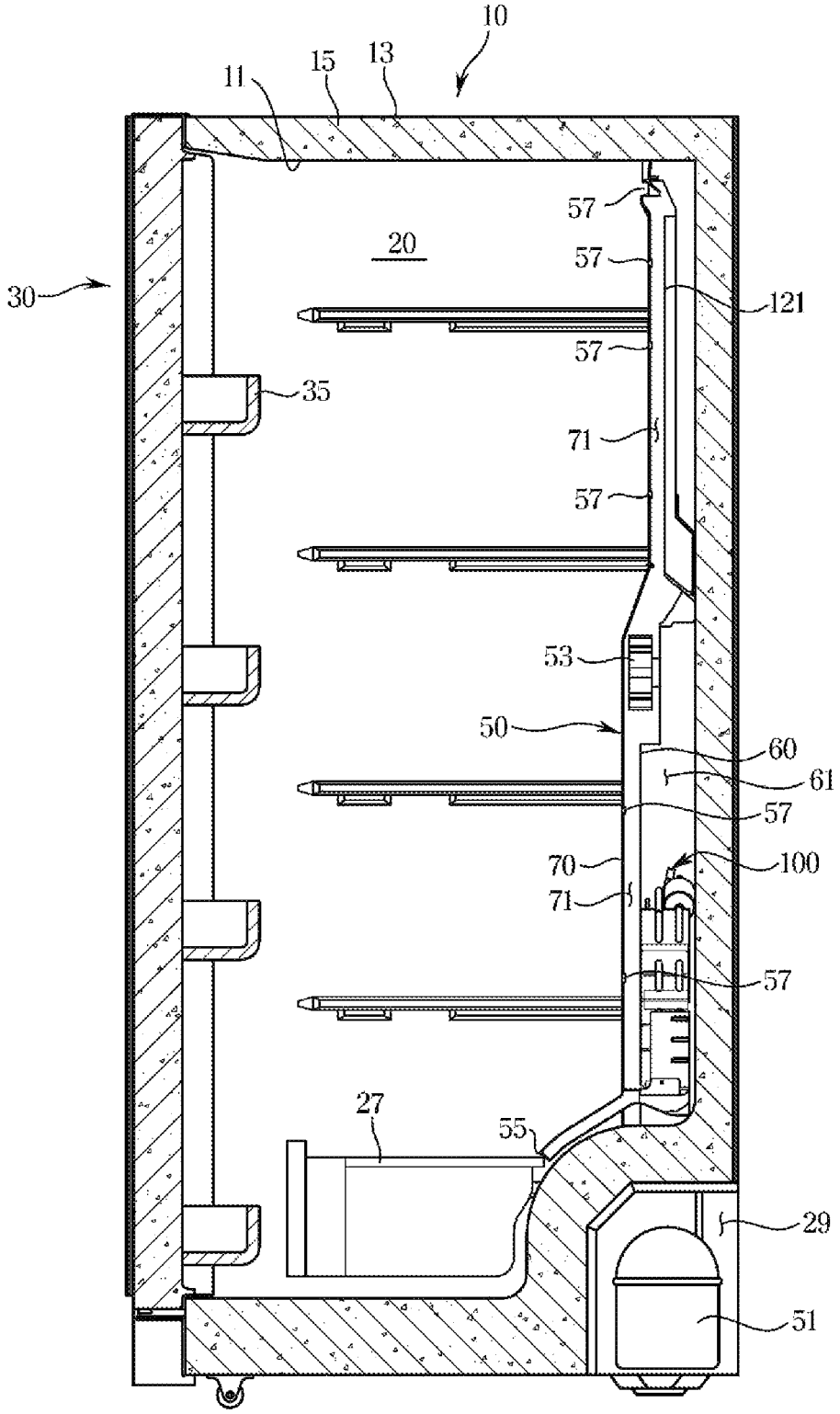
FIG. 2 illustrates a side cross-sectional view of a refrigerator, according to an embodiment of the disclosure.

FIG. 1 illustrates a perspective view of a refrigerator, according to an embodiment of the disclosure, and FIG. 2 illustrates a side cross-sectional view of a refrigerator, according to an embodiment of the disclosure.

Referring to FIGS. 1 to 2, a refrigerator may include a main body 10 that defines the exterior, a storeroom 20 with the front open, which is formed inside the main body 10, a door 30 pivotally coupled to the main body 10 to open or close the open front of the storeroom 20, and a hinge 40 that enables the door 30 to be pivotally coupled to the main body 10.

The main body 10 may include an inner case 11 that defines the storeroom 20 and an outer case 13 that defines the exterior, and an insulation 15 may be foamed between the inner case 11 and the outer case 13 for preventing cold air from leaking out. The main body 10 may include a partition wall 17 for dividing the storeroom 20 into a fridge 21 and a freezer 23 on the left and right, and there is a machine room 29 arranged on rear and bottom side of the main body 10, including a compressor 51 for compressing the refrigerant and a condenser (not shown) for condensing the compressed refrigerant.

The storeroom 20 may be divided by the partition wall 17 into left and right rooms, the right room being a fridge 21 and the left room being a freezer 23. In the storeroom 20, there may be a plurality of shelves 25 and containers 27 to store food and groceries.

The storeroom 20 may be opened or closed by the doors 30 pivotally coupled to the main body 10, and specifically, the fridge 21 and freezer 23 separated by the partition wall 17 are opened or closed by a fridge door 31 and a freezer door 33, respectively. On the rear sides of the fridge and freezer doors 31 and 33, a plurality of door shelves 35 are arranged to contain food.

The refrigerator may include a cold air supplier 50 for supplying cold air into the storeroom 20. The cold air supplier 50 may include a cooling cycle mechanism comprised of an evaporator 100, the compressor 51, the condenser and an expansion valve (not shown), a fan 53 forcing the cold air produced from the evaporator 100 to move into the storeroom 20, and ducts 60 and 70 defining air flow paths.

The cold air supplier 50 may be defined to include the evaporator 100, the fan 53, the ducts 60 and 70, etc., which are directly related to cold air supply, excluding the compressor 51, the condenser, etc., which are installed in the machine room 29. Hence, a heat exchanger 100 included in the cold air supplier 50, which will be described below, refers to the evaporator 100.

Although the cold air supplier 50 is shown as being arranged behind or on the back of the storeroom 20 in FIG. 2, the arrangement of the cold air supplier 50 is not limited thereto.

The cold air supplier 50 may include the heat exchanger 100, the ducts 60 and 70 defining flow paths of air inside the cold air supplier 50, and the fan 53 generating air flows inside the ducts 60 and 70.

The ducts 60 and 70 may include an air intake duct 60 defining an air inlet path 61 into which the air of the storeroom 20 flows and passes through the heat exchanger 100, and an air exhaust duct 70 defining an air outlet path 71 through which to supply the cold air that has passed the air intake duct 60 and the heat exchanger 100 into the storeroom 20. The air intake duct 60 is arranged in the upstream of the fan 53 and the air exhaust duct 70 is arranged in the downstream of the fan 53.

An inlet 55 may be arranged at an end of the air intake duct 60, through which the air of the storeroom 20 flows in, and a plurality of outlets 57 may be arranged on the air exhaust duct 70 to distribute the cold air across the storeroom 20.

Figure 3:
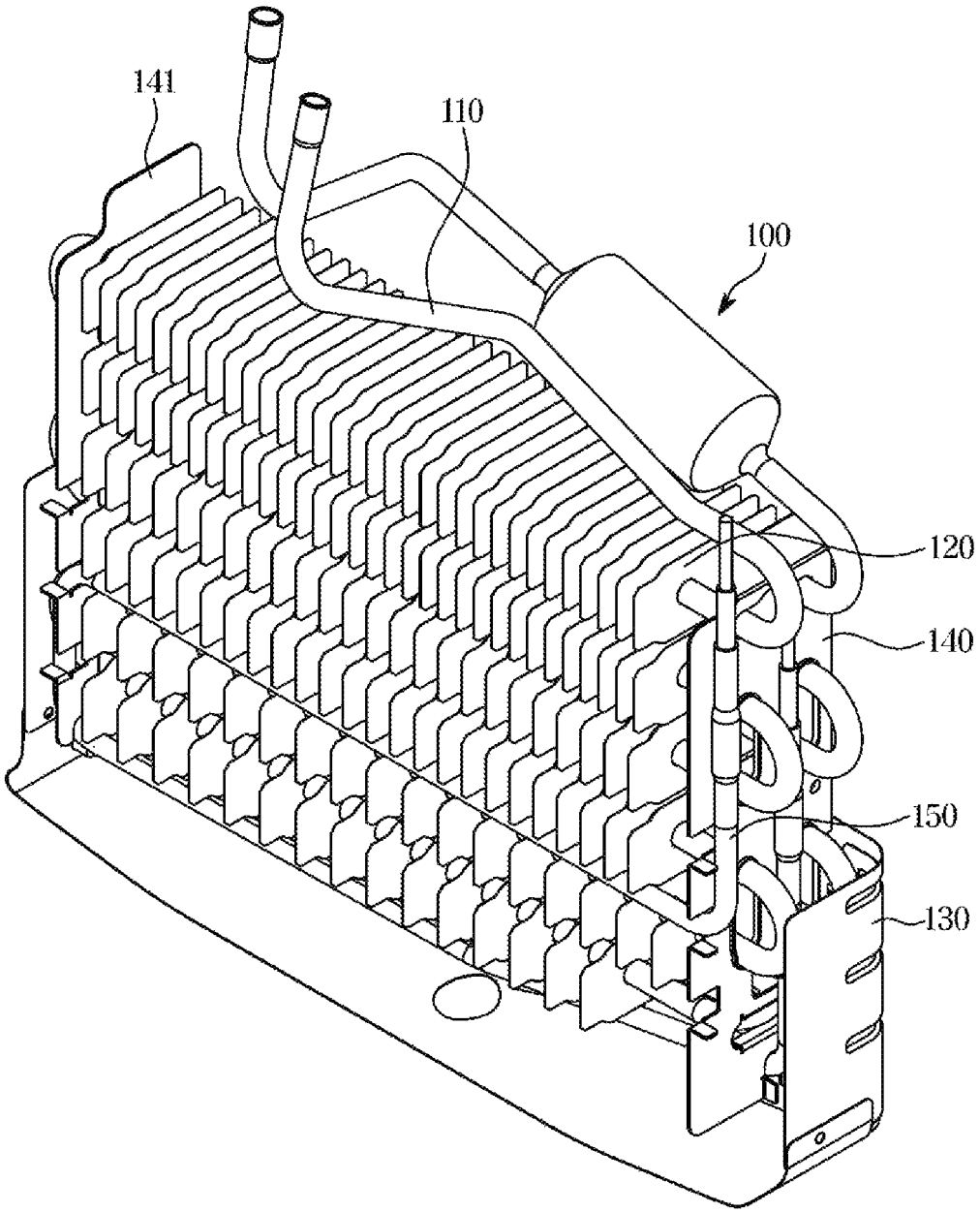
FIG. 3 illustrates a perspective view of a heat exchanger, according to an embodiment of the disclosure.
Figure 4:
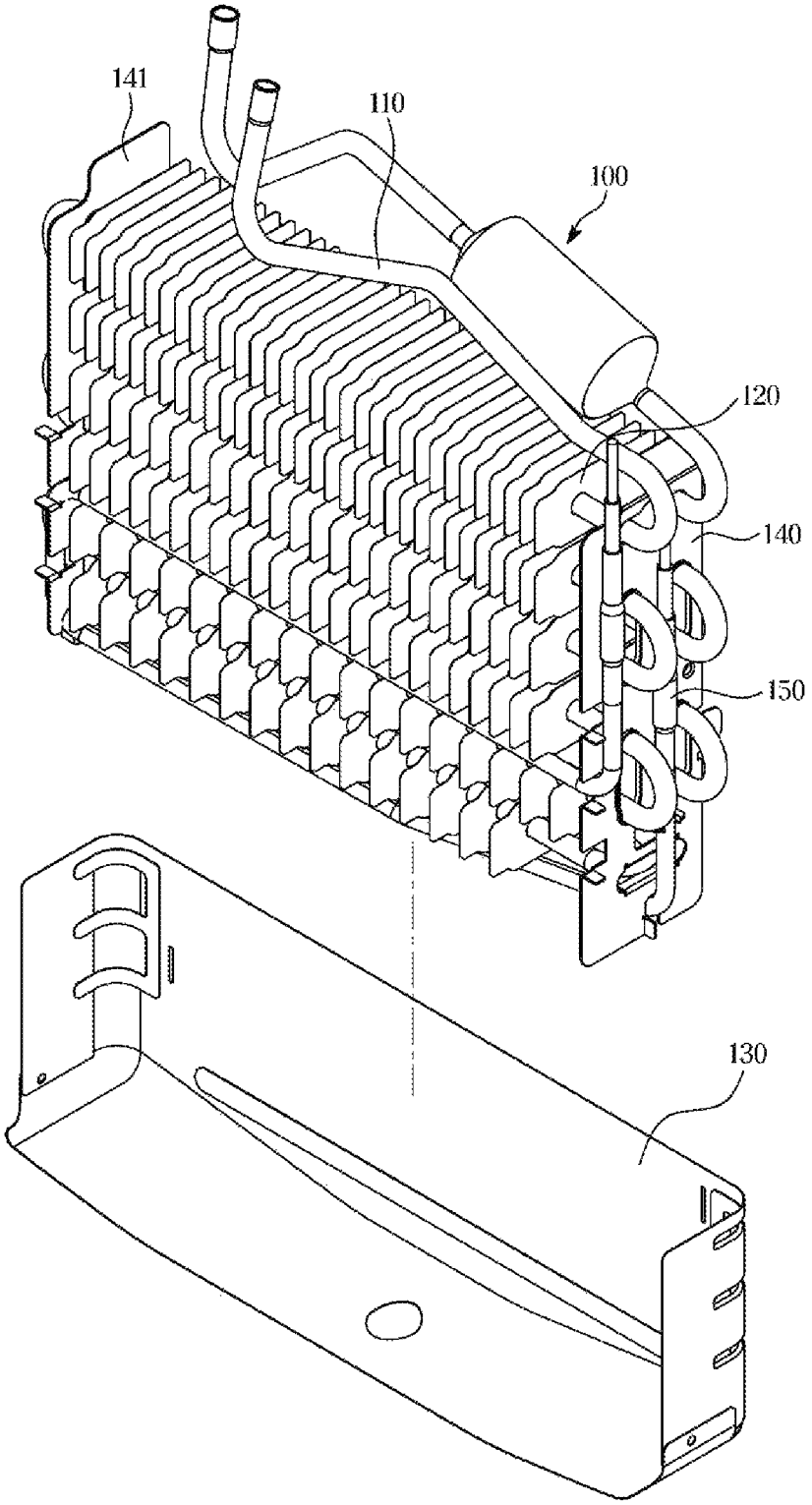
FIG. 4 illustrates an exploded view of the heat exchanger of FIG. 3 with a tray separated therefrom.
Figure 5:
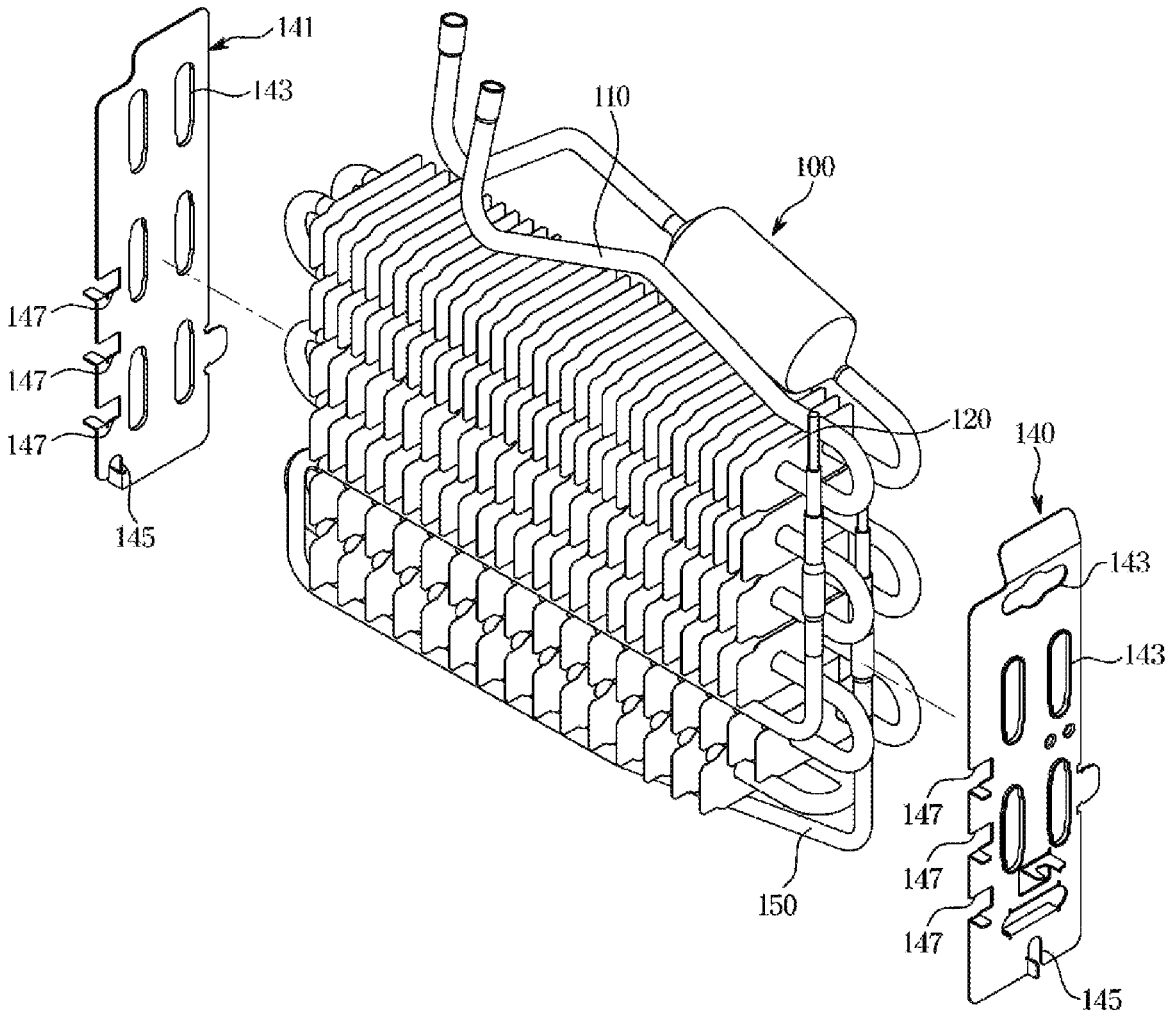
FIG. 5 illustrates an exploded view of the heat exchanger of FIG. 4 with brackets separated therefrom.
Figure 6:
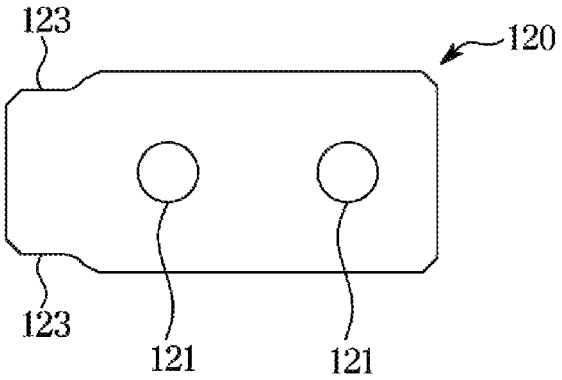
FIG. 6 illustrates a fin of the heat exchanger of FIG. 5.
Figure 7:
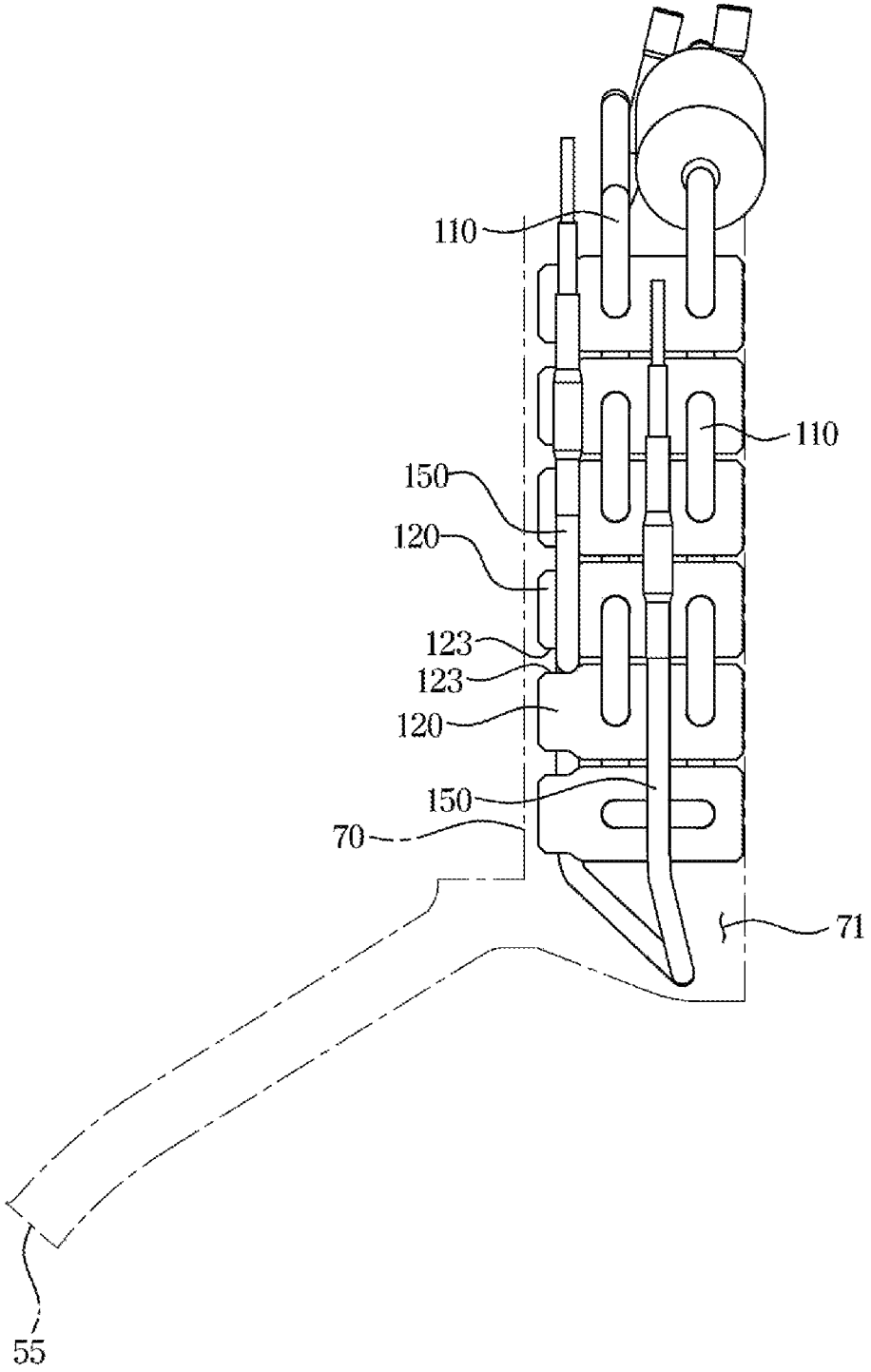
FIG. 7 illustrates a side view of the heat exchanger of FIG. 5.
Figure 8:
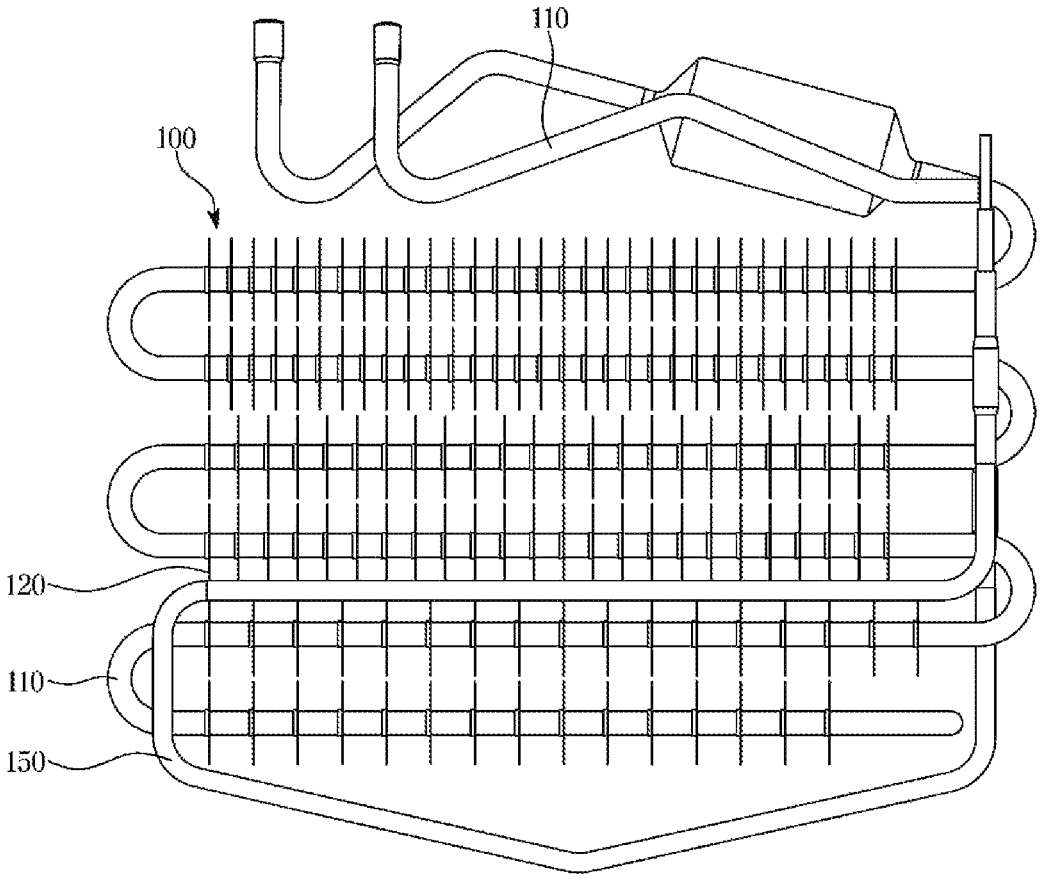
FIG. 8 illustrates a front view of the heat exchanger of FIG. 5.

FIG. 3 illustrates a perspective view of a heat exchanger, according to an embodiment of the disclosure, FIG. 4 illustrates an exploded view of the heat exchanger of FIG. 3 with a tray separated therefrom, FIG. 5 illustrates an exploded view of the heat exchanger of FIG. 4 with brackets separated therefrom, FIG. 6 illustrates a fin of the heat exchanger of FIG. 5, FIG. 7 illustrates a side view of the heat exchanger of FIG. 5, and FIG. 8 illustrates a front view of the heat exchanger of FIG. 5.

Referring to FIGS. 3 to 8, the cold air supplier 50 may include the heat exchanger 100 for producing cold air, a heater 150 for getting rid of frost formed on the heat exchanger 100, brackets 140 and 141 for supporting the heat exchanger 100 and the heater 150, and a tray 130 for wrapping a portion of the heat exchanger 100. The tray 130 may be arranged to collect and discharge water drops when the frost formed on the heat exchanger 100 melts into the water drops, which then falls under the heat exchanger 100.

The tray 130 may define a portion of the air intake duct 60 that forms the flow path of air that passes through the heat exchanger 100. As will be described below, the duct 60 refers to all or part of the air intake duct 60 that accommodates the heat exchanger 100 and defines the flow path of air to pass through the heat exchanger 100.

The heat exchanger 100 may include a tube 110 in which the refrigerant flows, and fins 120 coupled to the outer surface of the tube 110. The heat exchanger 100 may include a plurality of fins 120. The fins 120 contact the outer surface of the tube 110 and facilitate heat exchange between the refrigerant flowing in the tube 110 and the air passing through the heat exchanger 100. The heat exchanger 100 may also be defined to include the fins 120, the tube 110, the duct 60, etc., which are directly related to producing cold air.

The fins 120 may be made with various metal substances including high conductive aluminum. The fins 120 may have the form of plates. The plurality of fins 120 may be arranged separately in the left-right direction of the heat exchanger 100, which is perpendicular to an air flowing direction. The narrower the gap between the plurality of fins is, the more the fins 120 may be arranged, but when the gap is excessively narrow, it serves as resistance to the air passing through the heat exchanger 100, which is likely to cause a pressure loss, so the gap should be adjusted appropriately.

The plurality of fins 120 may be arranged separately in the vertical direction, which corresponds to the air flowing direction. In this case that the air moves up from a lower side to an upper side, the gap in the left-right direction between the plurality of fins 120 arranged on the lower side may be wider than that on the upper side.

The tube 110 may be arranged to pass through the plurality of fins 120 horizontally in the left-right direction of the heat exchanger 100, which is perpendicular to the air flow direction. When the plurality of fins 120 are arranged vertically along the air flow direction, the tube 110 may also be provided to bend to cross several times along the air flow direction.

The tube 110 of the heat exchanger 100 may be arranged to be lopsided to a side from the center of the air flow direction in the air flow path 61 defined by the duct 60. The fin 120 may include holes 121 through which the tube 110 passes, and the holes 121 may be arranged to be lopsided to either side of the fin 120. The tube 110 may pass through the fin 120 several times, and the fin 120 may include a plurality of holes 121 through which the tube 110 passes. The plurality of holes 121 may be arranged such that the center of each of the holes 121 is lopsided to a side from the center of the fin 120.

When the fan 53 forces air to flow without the fins 120 and the tube 110 arranged inside the duct 60, the air flows generated by the fan 53 inside the duct 60 may not be evenly distributed. In other words, a flow rate of the air in the air flow path 61 may be faster on one side from the center of the air flow direction than on the other side.

The tube 110 may be arranged to be lopsided to the side on which the flow rate of the air produced by the fan 53 in the duct 60 is relatively fast. With this, the flow rate of the air in the air flow path 61 is made even due to the air resistance caused by the tube 110, and the heat exchanger 100 may efficiently use the heat exchange area of the fin 120.

When the inlet 55 of air is arranged on one side of the duct 60, the air flow rate on the other side opposite from the one side may be faster than that on the one side. In this case, the tube 110 may be arranged to be lopsided to the other side opposite from the one side of the duct 60 on which the inlet 55 is arranged.

When the cold air supplier 50 is arranged behind the storeroom 20 and thus the inlet 55 of the duct 60 is arranged in front of the cold air supplier 50, air flows are lopsided toward the back of the duct 60 and the air flow rate at the back of the air flow path 61 becomes faster. In this case, the tube 110 may be arranged to be lopsided to the back of the duct 60.

When the hole 121 formed at the fin 120 for the tube 110 to pass through is located to be lopsided to one side from the center of the fin 120, a cut-out 123 with a portion of the fin 120 removed may be formed on the other side opposite from where the hole 121 of the fin 120 is arranged. Heat exchange efficiency is relatively high on the side where the hole 121 of the fin 120 is arranged and relatively low on the other side. Even though the portion having low heat exchange efficiency is removed from the fin 120, there is no difference in overall heat exchange efficiency of the fin 120. This may reduce the weight of the fin 120 and save the cost.

The cut-out 123 may be formed at a corner of the fin 120 having the form of a substantially rectangular plate. The cut-out 123 may be formed at both corners or a single corner on a side of the fin 120. Although not shown, the cut-out 123 may be formed on an edge of the fin 120 having the form of a substantially rectangular plate.

The cold air supplier 50 may include the heater 150 to get rid of frost formed on the heat exchanger 100. The heater 150 may have the form of a pipe to convey heat. The heater 150 may be arranged to pass along the side and the bottom of the heat exchanger 100. When the cold air supplier 50 is arranged behind the storeroom 20, the heater 150 may be arranged to pass along the front and the bottom of the heat exchanger 100. The heater 150 may lie in the left-right direction to cross the side or the front of the heat exchanger 100.

The cut-out 123 formed at the fin 120 may be arranged on a side where the heater 150 is arranged. When the cold air supplier 50 is arranged behind the storeroom 20, the cut-out 123 may be formed on the front of the fin 120. The cut-out 123 may provide space in which to arrange a portion of the heater 150. A portion of the heater 150 may be arranged on a side to or in front of the heat exchanger 100 to pass through the space formed by the cut-out 123 of the fin 120.

When the plurality of fins 120 are arranged in parallel along the air flow direction, two neighboring fins 120 along the air flow direction may each include the cut-out 123 at a corner facing each other. The height of the cut-out 123 may be set to correspond to half the thickness of the heater 150. Accordingly, the heater 150 may be arranged to pass through the space defined by the two cut-outs 123 of the two neighboring fins 120.

With the heater 150 arranged on a side to and under the heat exchanger 100, temperature distribution for defrosting is enhanced, thereby reducing time and energy for defrosting. This may prevent the defrosting heat from permeating into the storeroom, thereby keeping foods fresher.

The cold air supplier 50 may include brackets 140 and 141 to support the heat exchanger 100 and the heater 150. The brackets 140 and 141 may be arranged on either side of the heat exchanger 100 and heater 150. The brackets 140 and 141 may include a plurality of holes 143 through which the tube 110 passes, and a plurality of recesses 145 and 147 through which the heater 150 passes.

The heater 150 may be supported on the recesses 145 formed at the bottom of the brackets 140 and 141 and the recesses 147 formed on a side of the brackets 140 and 141. As the heater 150 may be supported on a total of four points arranged on the two brackets 140 and 141 arranged on either side of the heat exchanger 100, it may be supported more securely.

The two brackets 140 and 141 may each include a plurality of recesses 147 formed on a side. As the brackets 140 and 141 each include a plurality of recesses 147 on a side of the brackets 140 and 141 based on the height, the heater 150 may be arranged at appropriate height as needed, and may be arranged to cross the side of the heat exchanger 100 several times as needed.

Figure 9:
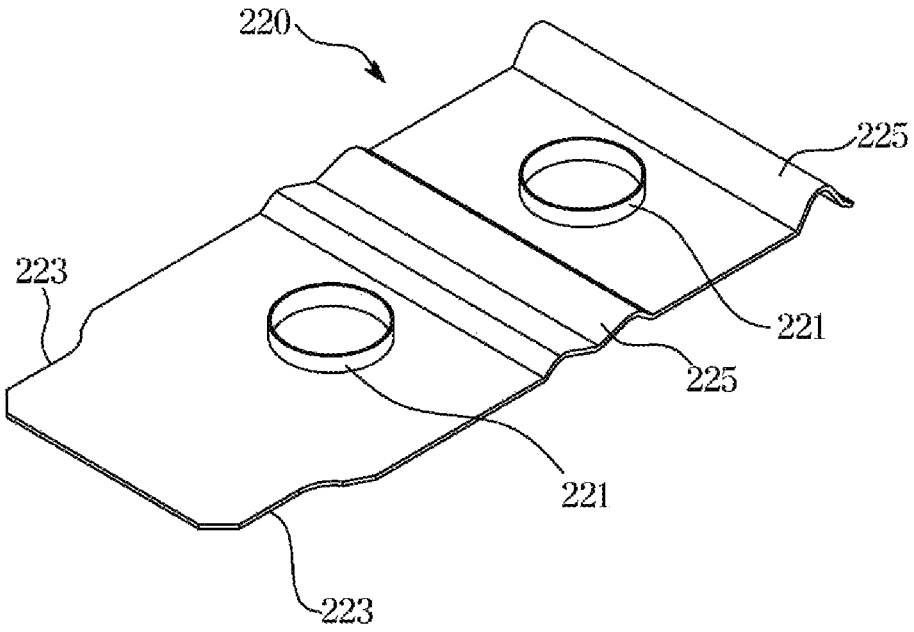
FIG. 9 illustrates a fin of a heat exchanger, according to another embodiment of the disclosure.

FIG. 9 illustrates a fin of a heat exchanger, according to another embodiment of the disclosure.

Referring to FIG. 9, a fin 220 shaped like a plate may include a bent portion 225 for expanding the heat exchange area. The fin 220 may include a hole 221 through which the tube 110 passes. The bent portion 225 may be formed at a location where no hole 221 of the fin 220 is formed. To increase the heat exchange efficiency, the bent portion 225 may be formed to be lopsided to the same side where the hole 221 is formed on the fin 220. The bent portion 225 may be formed on an edge of the side to which the hole 221 is lopsided.

The fin 220 may include a plurality of bent portions 225. In the case that the fin 220 includes a plurality of holes 221 and a plurality of bent portions 225, the bent portions 225 may be arranged between the plurality of holes 221 and the plurality of holes 221 may be formed on an edge of the side to which the plurality of holes 221 are lopsided.

When the bent portions 225 formed at the fin 220 are located to be lopsided to one side from the center of the fin 220, a cut-out 223 with a portion of the fin 220 removed may be formed on the other side opposite from where the bent portions 225 of the fin 220 are arranged. The fin 220 including the bent portion 225 and the cut-out 223 may replace the fin 120 included in the heat exchanger 100 shown in FIGS. 3 to 8.

Figure 10:
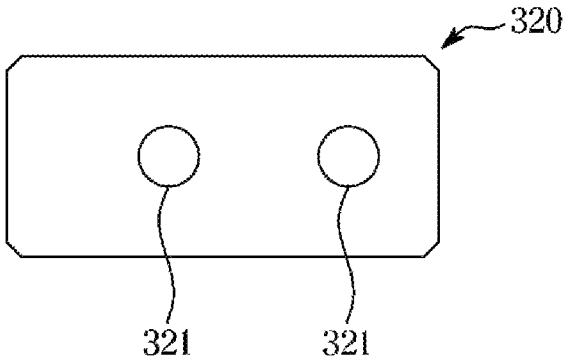
FIG. 10 illustrates a fin of a heat exchanger, according to another embodiment of the disclosure.
Figure 11:
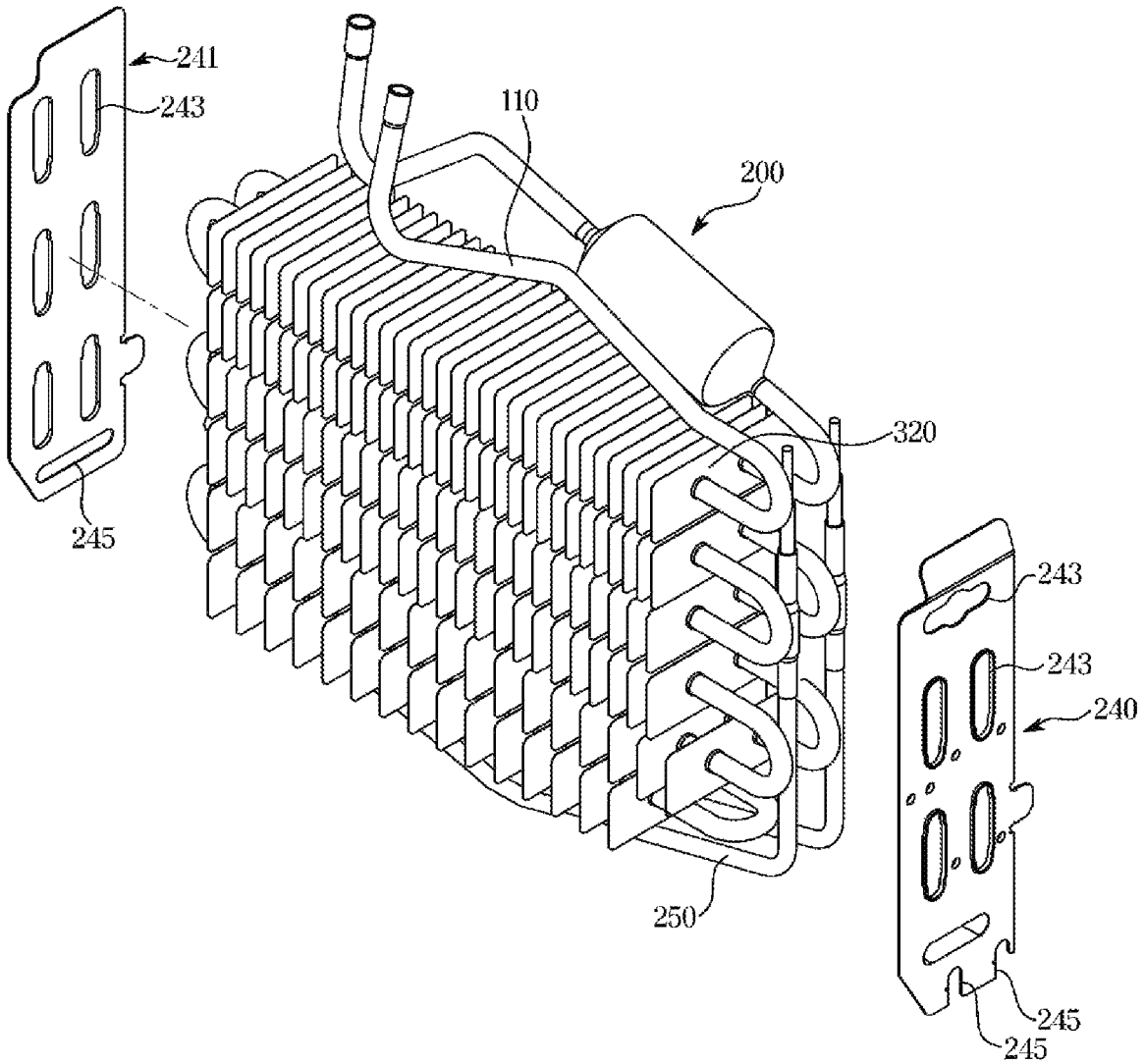
FIG. 11 illustrates an exploded view of a heat exchanger including the fin of FIG. 10 with brackets separated therefrom.
Figure 12:
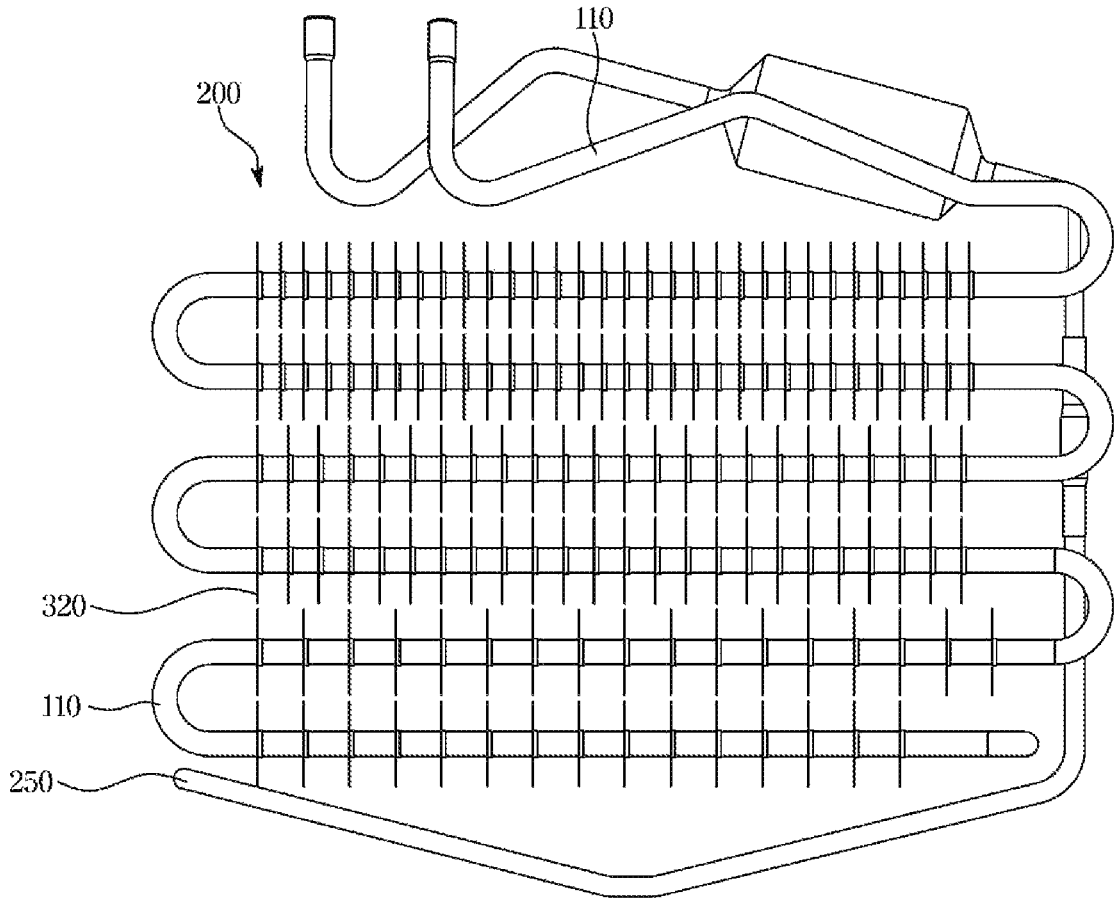
FIG. 12 illustrates a front view of the heat exchanger of FIG. 11.

FIG. 10 illustrates a fin of a heat exchanger, according to another embodiment of the disclosure, FIG. 11 illustrates an exploded view of a heat exchanger including the fin of FIG. 10 with brackets separated therefrom, and FIG. 12 illustrates a front view of the heat exchanger of FIG. 11.

Referring to FIGS. 10 and 12, a fin 320 of a heat exchanger 200 may include a hole 321 formed to be lopsided to a side from the center of the fin 320. The fin 320 may not include any extra cut-out.

A cold air supplier including the heat exchanger 200 may include a heater 250 to get rid of frost formed on the heat exchanger 200. The heater 250 may be arranged underneath the heat exchanger 200 to convey heat to the heat exchanger 200 by convection.

The cold air supplier may include brackets 240 and 241 to support the heat exchanger 200 and the heater 250. The brackets 240 and 241 may be arranged on either side of the heat exchanger 200 and heater 250. The brackets 240 and 241 may include a plurality of holes 243 through which the tube 110 passes, and a plurality of holes or recesses 245 through which the heater 250 passes.

Figure 13:
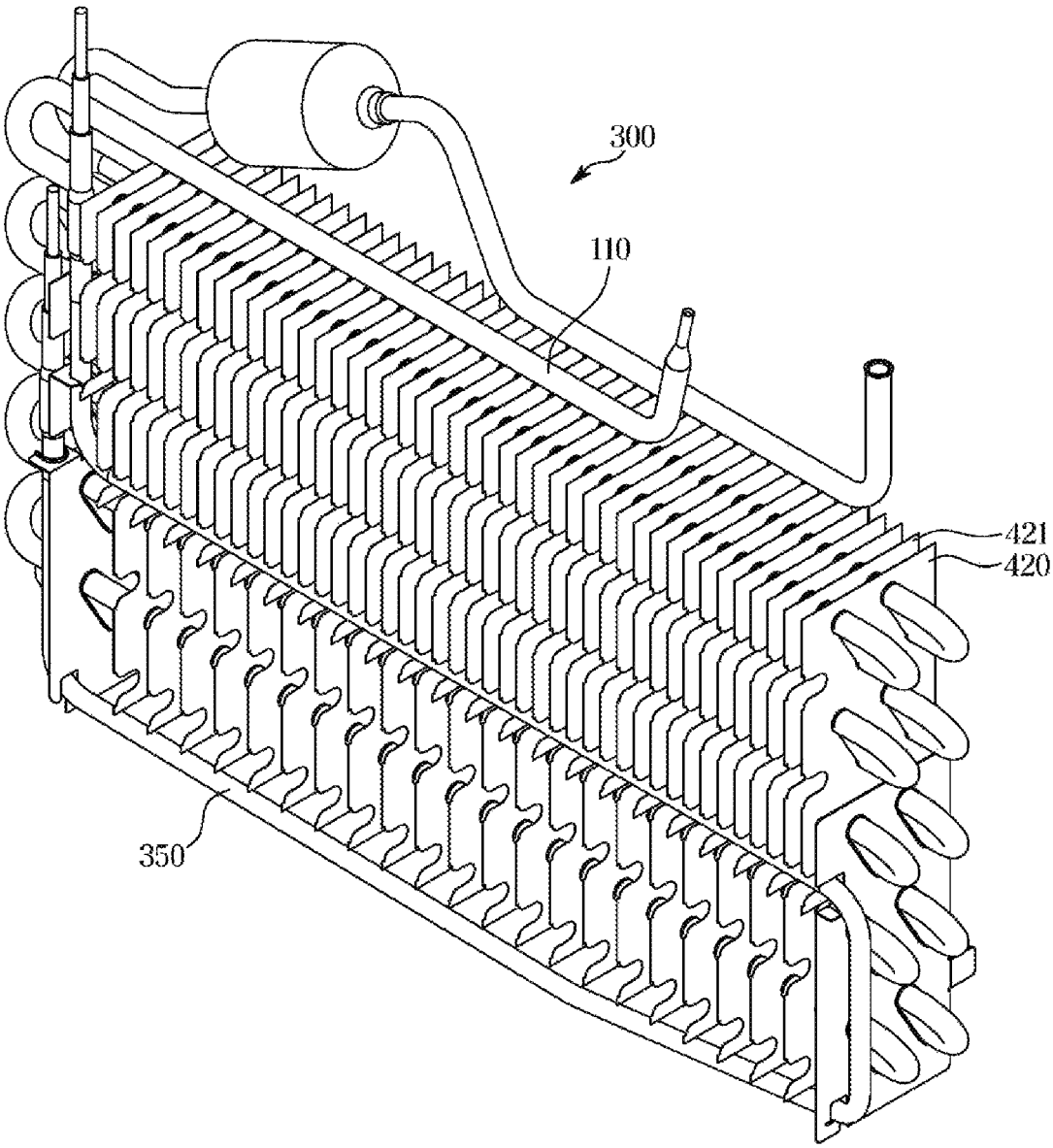
FIG. 13 illustrates a perspective view of a heat exchanger with a tray separated therefrom, according to another embodiment of the disclosure.
Figure 14:
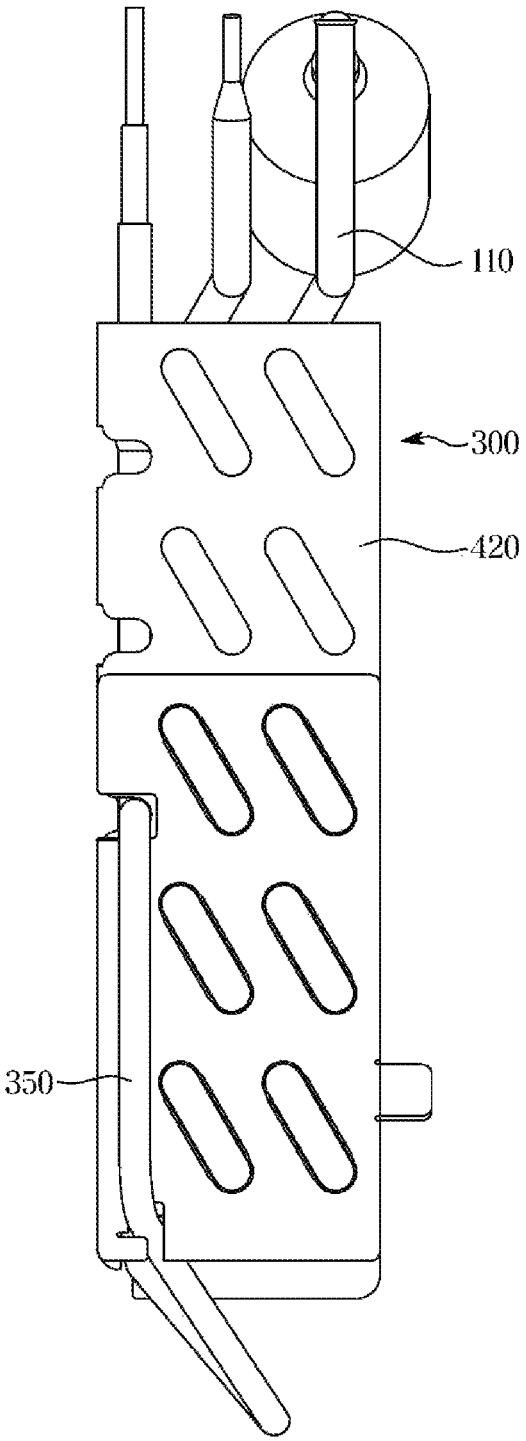
FIG. 14 illustrates a side view of the heat exchanger of FIG. 13.
Figure 15:
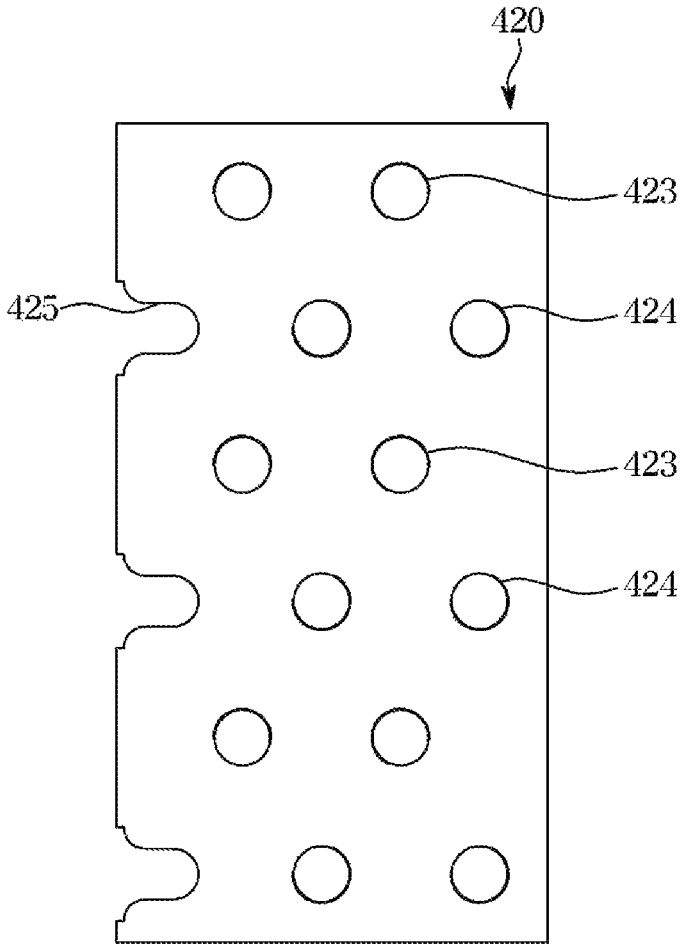
FIG. 15 illustrates a first fin of the heat exchanger of FIG. 13.
Figure 16:
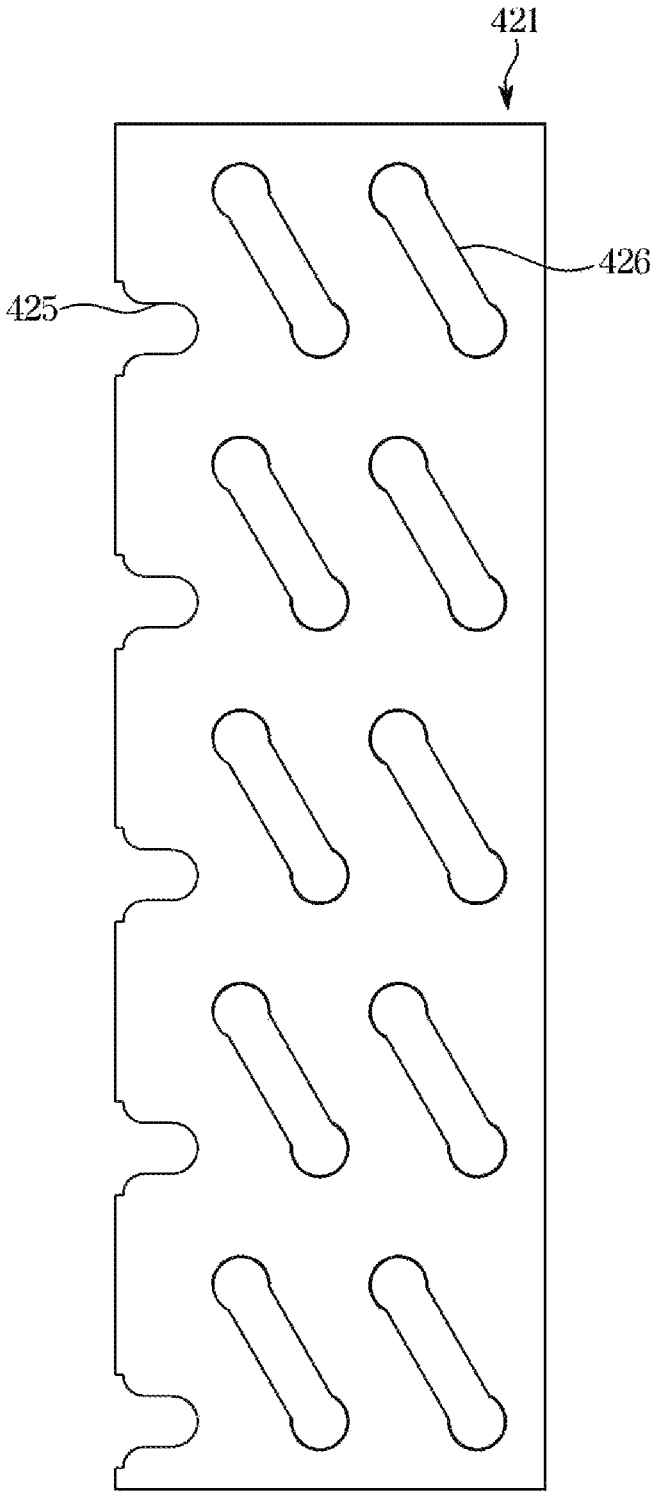
FIG. 16 illustrates a second fin of the heat exchanger of FIG. 13.

FIG. 13 illustrates a perspective view of a heat exchanger with a tray separated therefrom, according to another embodiment of the disclosure, FIG. 14 illustrates a side view of the heat exchanger of FIG. 13, FIG. 15 illustrates a first fin of the heat exchanger of FIG. 13, and FIG. 16 illustrates a second fin of the heat exchanger of FIG. 13.

Referring to FIGS. 13 to 16, the heat exchanger 300 may include the tube 110 in which the refrigerant flows, and first and second fins 420 and 421 coupled to the outer surface of the tube 110. A heat exchanger 300 may include a plurality of first fins 420 and a plurality of second fins 421. The first and second fins 420 and 421 contact the outer surface of the tube 110 and facilitate heat exchange between the refrigerant flowing in the tube 110 and the air passing the heat exchanger 300.

The first and second fins 420 and 421 may be made with various metal substances including high conductive aluminum. The first and second fins 420 and 421 may be formed in plates. The plurality of first and second fins 420 and 421 may be arranged separately in the left-right direction of the heat exchanger 300, which is perpendicular to an air flow direction. The narrower the gap between first and second fins 420 and 421 is, the more the first and second fins 420 and 421 may be arranged, but when the gap is excessively narrow, it serves as resistance to the air passing through the heat exchanger 300, which is likely to cause a pressure loss, so the gap should be adjusted appropriately.

The first fins 420 may be formed in plates shorter in length than the second fins 421. When the air flows upward from a lower side to an upper side, the first and second fins 420 and 421 may be alternately arranged in the left-right direction of the heat exchanger 300, which is perpendicular to the air flow direction, taking into account the air resistance. As the plurality of second fins 421 are arranged in the lower portion of the heat exchanger 300 and the plurality of first and second fins 420 and 421 are alternately arranged in the upper portion of the heat exchanger 300, the gap in the left-right direction between the fins in the lower portion of the heat exchanger 300 may be wider than that in the upper portion.

The tube 110 may be arranged to pass through the plurality of first and second fins 420 and 421 or the plurality of second fins 421 horizontally in the left-right direction of the heat exchanger 100, which is perpendicular to the air flow direction. Furthermore, the tube 110 may be formed to bend to cross several times along the air flow direction.

The tube 110 of the heat exchanger 300 may be arranged to be lopsided to a side from the center of the air flow direction in the air flow path 61 (see FIG. 2) defined by the duct 60 (also see FIG. 2). The first and second fins 420 and 421 may include holes 423, 424, and 426 through which the tube 110 passes.

The first and second fins 420 and 421 may include first holes 423 arranged in the center of the first and second fins 420 and second holes 424 lopsided to a side. The first and second holes 423 and 424 may be alternately arranged along the air flow direction. The first and second fins 420 and 421 may also include third holes 426 in the form of the first and second holes 423 and 424 combined.

Once the tube 110 is arranged to pass through the first and second holes 423 and 424 alternately arranged along the air flow direction, the tube 110 may easily contact air, thereby improving the efficiency of the heat exchanger 300. The first and second fins 420 and 421 may include the plurality of first and second holes 423 and 424 in the horizontal direction. The first and second fins 420 and 421 may include the plurality of third holes 426 in the horizontal direction. The plurality of second or third holes 424 or 426 may have a lopsided center, which is lopsided from the center of the first and second fins 420 and 421.

When the second or third holes 424 or 426 formed at the first and second fins 421 for the tube 110 to pass through are lopsided from the center of the first and second fins 420 and 421, cut-outs 425 with portions of the first and second fins 420 and 421 removed may be formed on the other side opposite from where the second or third holes 424 or 426 of the first and second fins 420 and 421 are arranged. When the first and second fins 420 and 421 includes the first and second holes 423 and 424, the cut-outs 425 may be made in parallel with the second holes 424. When the first and second fins 420 and 421 include the third holes 426, the cut-outs 425 may be made in parallel with the rear ends of the third holes 426. The cut-outs 425 may be formed on an edge of a side of the first or second fin 420 or 421 having the form of a substantially rectangular plate. The first and second fins 420 and 421 may include a plurality of cut-outs 425 in the vertical direction.

Heat exchange efficiency is relatively high on the side where the second or third holes 424 or 426 of the first and second fins 420 and 421 are arranged and relatively low on the other side. Even though the portion having the low heat exchange efficiency is removed from the first and second fins 420 and 421, there is no difference in overall heat exchange efficiency of the first and second fins 420 and 421. This may reduce the weight of the first and second fins 420 and 421 and save the cost.

The heater 350 may be arranged to pass along the side and the bottom of the heat exchanger 300. When the cold air supplier 50 (see FIG. 2) is arranged behind the storeroom 20 (also see FIG. 2), the heater 350 may be arranged to pass along the front and bottom of the heat exchanger 300. The heater 350 may lie in the left-right direction to cross the side or the front of the heat exchanger 300.

The cut-outs 425 formed at the first and second fins 420 and 421 may be arranged on a side where the heater 350 is arranged. When the cold air supplier 50 is arranged behind the storeroom 20, the cut-outs 425 may be formed on the front of the first and second fins 420 and 421. The cut-out 425 may provide space in which to arrange a portion of the heater 150. The portion of the heater 350 may be arranged on a side to or in front of the heat exchanger 300 to pass through the space formed by the cut-outs 425 of the first and second fins 420 and 421.

According to embodiments of the disclosure, heat exchange efficiency between a refrigerant flowing in a tube and outside air can be improved.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a storeroom; and a cold air supplier configured to supply cold air into the storeroom, wherein the cold air supplier comprises:

a heat exchanger producing cold air, a duct accommodating the heat exchanger and defining a flow path for air to pass through the heat exchanger, a fan generating an air flow inside the duct, a heater for removing frost formed on the heat exchanger, and a bracket to support the heat exchanger and the heater, wherein the heat exchanger comprises:

a tube in which a refrigerant flows, and a fin coupled to an outer surface of the tube, wherein the tube is eccentrically arranged with respect to a central axis of the duct to be closer to a rear side of the duct than a front side of the duct, wherein the fin includes:

a plurality of holes through which the tube passes and including a first hole and a second hole formed at the rear of the first hole, wherein a center between the first hole and the second hole is eccentrically arranged with respect to a center of the fin, a first bent portion formed between the first hole and the second hole, a second bent portion formed on a rear end of the fin, and a cut-out formed on a front end opposite to the rear end on which the second bent portion is formed, wherein the heater is arranged to pass through the cut-out such that a first portion of the heater is arranged in front of the first hole of the fin, wherein the bracket includes a side recess formed on a front end of the bracket to face the front side of the duct and to support the heater which passes through the cut-out, and a bottom recess formed at the rear of the side recess, and wherein the heater is arranged to be supported by the bottom recess of the bracket such that a second portion of the heater is arranged to pass between the first hole and the second hole of the fin.

2. The refrigerator of claim 1, wherein the tube is eccentrically arranged with respect to the central axis of the duct to be closer to the rear side of the duct on which the air flow generated by the fan in the duct is relatively fast.

3. The refrigerator of claim 1, wherein:

the duct comprises an inlet on one side through which air of the storeroom flows in, and the tube of the heat exchanger is eccentrically arranged with respect to the central axis of the duct to be closer to another side opposite from the side on which the inlet is arranged.

4. The refrigerator of claim 1, wherein the heat exchanger and the duct are arranged behind the storeroom.

5. The refrigerator of claim 1, wherein the fin is shaped like a plate.

6. The refrigerator of claim 1, wherein the first bent portion and the second bent portion are formed in a portion of the fin in which the plurality of holes are not formed.

7. The refrigerator of claim 1, wherein:

the heat exchanger comprises a plurality of fins arranged in a direction parallel to a flow direction of the air, each of the plurality of fins comprises the cut-out at a corner on one side, and the heater passes through space formed by two cut-outs of two neighboring fins of the plurality of fins.

8. The refrigerator of claim 1, wherein:

the heat exchanger comprises a plurality of fins arranged in a direction perpendicular to a flow direction of the air, and each of the plurality of fins comprises a plurality of cut-outs on an edge of a side.

9. The refrigerator of claim 1, wherein the heater is arranged to pass along a side and a bottom of the heat exchanger.

10. The refrigerator of claim 1, wherein the bracket includes a plurality of side recesses on the front end of the bracket to support the heater.

11. A refrigerator comprising:

a storeroom;

a heat exchanger arranged behind the storeroom, and including a plurality of fins and a tube in which a refrigerant flows;

a duct accommodating the heat exchanger and defining a flow path for air to pass through the heat exchanger;

a heater for removing frost formed on the heat exchanger; and a bracket to support the heat exchanger and the heater, wherein each of the plurality of fins includes:

a plurality of holes through which the tube passes and including a first hole and a second hole formed at a rear of the first hole, wherein a center between the first hole and the second hole is eccentrically arranged with respect to the center of each of the plurality of the fins, a first bent portion formed between the first hole and the second hole, a second bent portion formed on a rear end of the fin, and a cut-out formed on a front end opposite to the rear end on which the second bent portion is formed, wherein the heater is arranged to pass through the cut-out such that a first portion of the heater is arranged in front of the first hole of the fin, wherein the bracket includes a side recess formed on a front end of the bracket to face a front side of the duct and to support the heater which passes through the cut-out, and a bottom recess formed at the rear of the side recess, and wherein the heater is arranged to be supported by the bottom recess of the bracket such that a second portion of the heater is arranged to pass between the first hole and the second hole of the fin.

12. The refrigerator of claim 11, wherein each of the plurality of fins comprises the cut-out formed on a front side for the heater to pass through.

13. The refrigerator of claim 11, wherein the first bent portion and the second bent portion are formed in a portion in which the tube does not pass.

14. A refrigerator comprising:

a storeroom;

a duct defining a flow path of air;

a heat exchanger configured to supply cold air into the storeroom and accommodated in the duct;

a heater for removing frost formed on the heat exchanger; and a bracket to support the heat exchanger and the heater, wherein the heat exchanger comprises:

a tube in which a refrigerant flows; and a fin including a plurality of holes through which the tube passes and including a first hole and a second hole formed at a rear of the first hole, wherein a center between the first hole and the second hole is eccentrically arranged with respect to a central axis of the duct to be closer to a side on which an air flow in the duct is relatively fast, wherein the fin includes:

a first bent portion formed between the first hole and the second hole, a second bent portion formed on a rear end of the fin, and a cut-out formed on a front end opposite to the rear end on which the second bent portion is formed, wherein the heater is arranged to pass through the cut-out such that a first portion of the heater is arranged in front of the first hole of the fin, wherein the bracket includes a side recess formed on a front end of the bracket to face a front side of the duct and to support the heater which passes through the cut-out, and a bottom recess formed at the rear of the side recess, and wherein the heater is arranged to be supported by the bottom recess of the bracket such that a second portion of the heater is arranged to pass between the first hole and the second hole of the fin.

15. The refrigerator of claim 14, wherein the cut-out is formed on a side opposite to the side on which the center between the first hole and the second hole is eccentrically arranged.

* * * * *